United States Patent [19]

Babuka et al.

[11] Patent Number: 4,872,851

[45] Date of Patent: Oct. 10, 1989

[54] ELECTRICAL CONNECTOR WITH TORSIONAL CONTACTS

[75] Inventors: Robert Babuka, Vestal; James R. Petrozello, Endicott, both of N.Y.

[73] Assignee: International Business Machines Corp., Armonk, N.Y.

[21] Appl. No.: 316,041

[22] Filed: Feb. 27, 1989

[51] Int. Cl.[4] ..... H01R 11/22

[52] U.S. Cl. ..... 439/267; 439/60; 439/635

[58] Field of Search ..... 439/260, 635, 636, 266, 439/267, 268, 269, 270, 60

[56] References Cited

U.S. PATENT DOCUMENTS

| | | | |
|---|---|---|---|
| 2,926,328 | 2/1960 | Flanagan, Jr. | 439/636 |
| 3,555,488 | 1/1971 | McIver et al. | 439/260 |
| 3,977,748 | 8/1976 | Gruhn et al. | 439/342 |
| 4,021,091 | 5/1977 | Anhalt et al. | 439/260 |
| 4,105,277 | 8/1978 | Jacob | 439/682 |
| 4,159,861 | 9/1979 | Anhalt | 439/267 |
| 4,314,736 | 2/1982 | Demnianiuk | 439/264 |
| 4,498,725 | 2/1985 | Bright et al. | 439/347 |
| 4,542,950 | 9/1985 | Gillett et al. | 439/325 |

OTHER PUBLICATIONS

IBM Technical Disclosure Bulletins, vol. 10, No. 11, 4-1968 (p. 1695); vol. 14, No. 1, 2-1972 (pp. 2597-2598); vol. 17, No. 2, 7-1974 (pp. 440-441); vol. 25, No. 11B, 4-1983 (pp. 3546-3548); vol. 26, No. 12, 5-1984 (P. 6657); vol. 27, No. 12, 5-1985 (pp. 7136-7137; vol. 30, No. 5, 10-1987 (pp. 289, 290).

*Primary Examiner*—Neil Abrams
*Assistant Examiner*—Khiem Nguyen
*Attorney, Agent, or Firm*—Lawrence R. Fraley

[57] ABSTRACT

An electrical connector for providing electrical connection to a substrate having contact elements thereon (e.g., a printed circuit board) wherein torsional contacts are utilized. The contacts, actuated by a vertically moving, slidable member (e.g., a cam plate) and horizontally moving actuator (e.g., a linear cam), resume a normal, twisted configuration to effect such connection with the respective contact elements. Each contact, preferably metallic (e.g., beryllium copper), includes a curvilinear edge segment while each contact element (e.g., plated copper wire) in turn includes a curvilinear contacting surface, these two members thus providing a single point form of contact while assuring effective wiping motion to remove undesirable contaminants, debris, etc. which may be located thereon. Relatively high contact forces (e.g., 200,000 PSI) are possible using the invention.

18 Claims, 4 Drawing Sheets

ELECTRICAL CONNECTOR WITH TORSIONAL CONTACTS

DESCRIPTION

1. TECHNICAL FIELD

The invention relates to electrical connectors and more particularly to electrical connectors of the zero insertion force (ZIF) variety (e.g., for receiving a printed circuit board (PCB) therein to provide contact thereto).

2. BACKGROUND

Electrical connectors, including ZIF electrical connectors, are well known in the art, with examples described in U.S. Pat. Nos. 3,555,488, 4,021,091, 4,159,861, 4,314,736 and 4,542,950, as well as in IBM Technical Disclosure Bulletins Vol. 10, No. 11, April, 1968 (p. 1695), Vol. 14, No. 9, February, 1972 (pp. 2597, 2598), Vol. 17, No. 2, July, 1974 (pp. 440, 441), Vol. 25, No. 11B, April, 1983 (pp. 5870, 5871), Vol. 26, No. 7B, December, 1983 (pp. 3549–3548), Vol. 26, No. 12, May, 1984 (p. 6657), Vol. 27, No. 12, May, 1985 (pp. 7136, 7137) and Vol. 30, No. 5, October, 1987 (pp. 289,290).

Typically, connectors of the type described in the foregoing patents and publications provide some means for engaging the electrical contact(s) located within the connector's housing to cause the contact(s) to bend (e.g., inwardly) to effect contact with the respective circuitry located on the positioned circuit board component, such bending typically occurring in a substantially inward and upward fashion within the housing to achieve a desired wiping action against this respective circuitry. See, e.g., 3,555,488, 4,021,091 and 4,542,950 as representative examples of such movement. Also, such deflection of the metallic contacts typically results in engagement between two relatively flat surfaces, those of the contacts and those of the respective circuitry, the latter usually is the form of a flat, plated material (e.g. copper) positioned in the board's insulative substrate. In some situations, the upper contacting portion of the contact may include a protuberance or similarly configured member which provides this connection. See especially 4,021,091. As defined further below, the present invention comprises an electrical connector capable of providing an effective wiping form of electrical contact between a circuit board and the contacts located within the connector in a new and unique fashion. The invention, as so defined, operates in a relatively simple manner and is, additionally, relatively inexpensive to produce.

It is believed that an electrical connector possessing the advantageous features cited herein would constitute a significant advancement in the art.

DISCLOSURE OF THE INVENTION

It is, therefore, a primary object of the present invention to enhance the electrical connector art.

It is a further object of the invention to provide an electrical connector capable of providing effective electrical connection to at least one contact element located on a substrate.

It is a still further object of the invention to provide such an electrical connector which operates in a new and unique manner to assure such positive connection.

It is another object of the invention to provide such a connector which operates in a relatively simple manner and which can be produced at relatively low costs in comparison to many connectors in the prior art, including, particularly, those of the cam-actuated variety as described in some of the aforementioned patents and publications (e.g., 3,555,488).

In accordance with one aspect of the invention, there is provided an electrical connector for providing electrical connection to at least one contact element located on a substrate, the connector comprising at least one torsional contact for contacting the contact element located on said substrate to provide the electrical connection, the torsional contact adapted for occupying a first, twisted orientation relative to the substrate and a second, substantially non-twisted orientation relative to the substrate, and means for engaging the torsional contact to cause the contact to move from the first, twisted orientation to the second, substantially non-twisted orientation.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
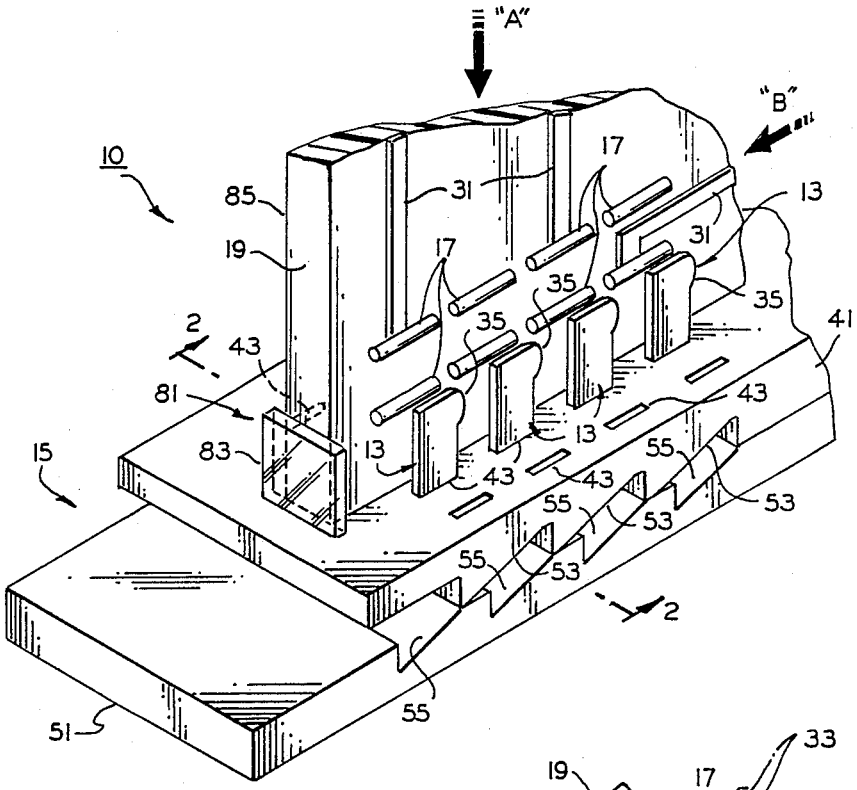
FIG. 1 is a partial perspective view of an electrical connector including torsional contacts and means for engaging such contacts to effect electrical connection to shown contact elements on a substrate, in accordance with a preferred embodiment of the invention.
Figure 2:
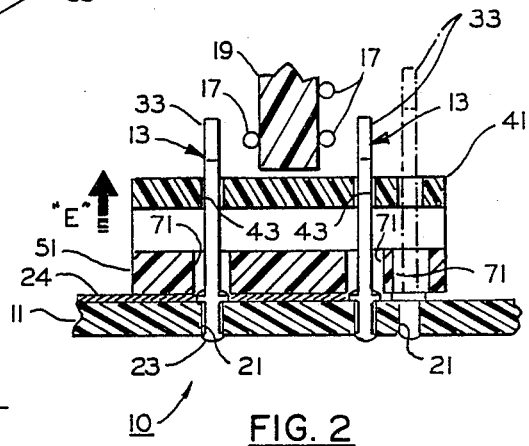
FIG. 2 is a side elevationed view, in section, of the components of the invention as shown in FIG. 1 and further including a base member in accordance with one embodiment of the invention, FIG. 2 being taken along the line 2—2 in FIG. 1.
Figure 3:
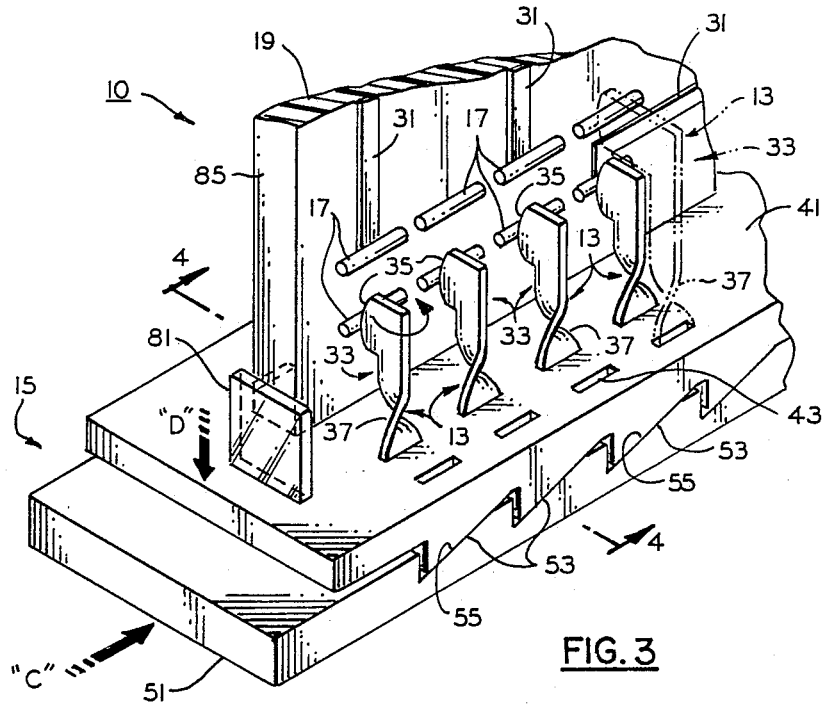
FIG. 3 is a partial perspective view, similar to FIG. 1, but illustrating the invention's torsional contacts in an actuated position.

An electrical connector 10 in accordance with a preferred embodiment of the invention is shown in detail in FIGS. 1–5. In its simplest form, electrical connector 10 includes a base member 11 (FIGS. 2, 4 and 5), at least one torsional contact 13, and means 15 for engaging the contact to cause it to move from a first, twisted orientation (FIG. 3) to a second, substantially non-twisted orientation (FIG. 1). As defined herein, electrical connector 10 is designed for providing sound wiping electrical connection between the aforementioned torsional contact and at least one contact element 17 located on a substrate when the substrate (e.g., a printed circuit board) is located within the connector. Although the invention is defined in its broadest form as including at least one contact 13, it is understood that in a preferred embodiment, several such members are utilized to mate with a corresponding, similar number of elements 17 which form part of the circuitry of the positioned circuit board. In FIG. 3, for example, the invention is shown as capable of accommodating a total of twelve such contacts 13 to provide an effective wiping connection with a similar number of contact elements located on the insulative substrate 19. Only five contacts 13 are depicted in FIG. 3 for illustration purposes, at least one of these being shown in phantom. In accordance with the teachings herein, it is preferred to utilize a total of from about 280 to about 560 of such contacts within a singular connector housing (defined below).

Each contact 13 is of relatively thin metallic material, preferably beryllium copper or phosphor bronze. In one example of the invention, as defined below, each contact had a thickness (dimension "T" in FIG. 8) of only about 0.010 inch. Additionally, each of the torsional contacts of the invention preferably include a quantity of plating material thereon, said material preferably palladium. This coating preferably has a normal thickness within the range of from only about 0.00006 inch to about 0.00008 inch. In addition to the aforementioned palladium plating, it is also possible to provide a secondary layer of plating of gold or similar precious material on the palladium. alternatively, a palladium/-nickel alloy may be utilized as the contact plating material.

Figure 4:
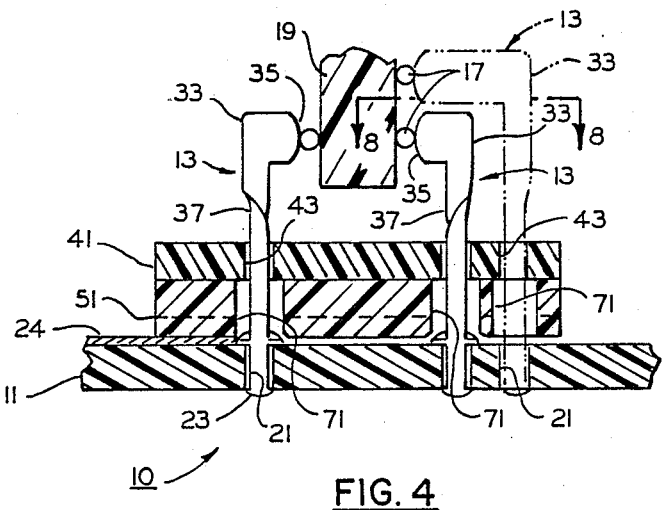
FIG. 4 is a side elevational view, similar to FIG. 2, as taken along the line 4—4 in FIG. 3.
Figure 5:
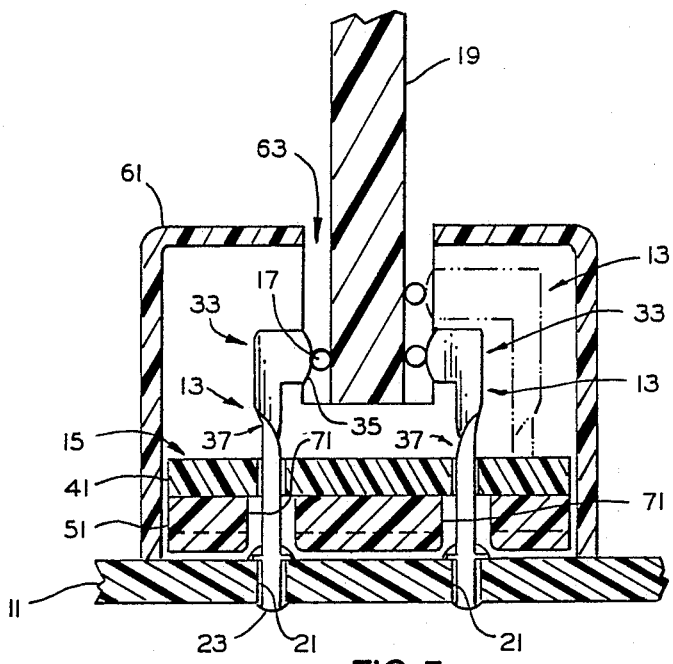
FIG. 5 is a side elevational view illustrating a preferred cover for the invention.

Significantly, each contact 13 of the invention possesses a twisted configuration in its normal operating position, such a configuration clearly illustrated in FIGS. 3, 4 and 5. Each contact 13 is thus formed to this original configuration prior to placement within the respective base member 11. Understandably, the invention uniquely involves the step of twisting (torsional actuation) each contact in a direction substantially away from substrate 19 prior to insertion thereof within the connector, and thereafter allowing each contact to return to its normal, twisted orientation so that effective connection is made between the contacts and respective elements (17) of the circuit board. This stressed, away, non-contacting position is illustrated in FIGS. 1 and 2. As stated, when in such a non-twisted orientation, the torsional contacts of the invention are incapable of providing sound electrical connection to the respective contact elements 17 on substrate 19. However, when actuated (as shown in FIGS. 3–5), each contact will assume its original, unstressed configuration and wipe across the respective external surface of each contact element 17.

It is to be understood that the invention is not limited to providing contact in only the original, twisted configuration shown herein. That is, it is well within the scope of the invention to provide such connection when the individual contacts 13 are in the stressed, non-twisted configuration as depicted in FIG. 1, such contact, for example, being provided by modification to the configuration of the circuit board (e.g., such that the contact elements 17 are oriented substantially between each respective pair of contacts 13) or the like. Additional definition is thus not believed necessary and the invention is understood as not being limited to the contacting configuration depicted in the drawings.

As defined, each contact is securely positioned within the base member 11 of the invention. Base member 11 is preferably an insulated substrate and includes a plurality of openings 21 therein. Openings 21 are each designed for having a terminal end portion 23 of a contact 13 seated therein, each opening preferably of substantially rectangular configuration, as is the corresponding end portion 23 to assure positive seating of each contact. Each end 23 may also be of compliant configuration (e.g., "eye-of-the-needle") as is known in the art and further description is thus not believed necessary. Additionally, each end 23 may instead be soldered or otherwise staked within the insulative substrate 11 (e.g., to provide positive electrical connection to circuitry or similar conductive elements located thereon or within the substrate). Base component 11 is preferably a printed circuit board or the like having at least one layer of circuitry (24) thereon or located therein in order that the respective contacts 13 may be electrically connected thereto. Only a portion of such circuitry is depicted in the drawings. Although contacts 13 are each defined as including a terminal end portion 23, it is also within the scope of the invention to provide a projecting tail portion (not shown) or the like which projects below the substrate (base component) 11 and thus is capable of being electrically connected to other electrical components (e.g., wiring). The terminal configuration 23 as depicted herein is thus not meant to limit the invention. It is necessary, however, that each contact 13 be firmly seated within the defined base member 11 to afford the unique advantages cited herein.

In FIGS. 1–5, the contacts 13 of the invention are illustrated as being positioned in two parallel rows on one side of substrate 19 and in a singular row on the opposite side thereof. This also is not meant to limit the invention, in that other orientations are readily possible. For example, it is within the scope of the invention to utilize but a singular row of contacts on each opposite side of the substrate 19 or, alternatively, use dual rows of such members on both sides. Should two rows of contacts be utilized, those located on the outer row are slightly longer (taller) in overall configuration (e.g., FIGS. 3, 4) and are adapted for contacting corresponding contact elements 17 located on substrate 19 above the respective lower contacts 17 contacted by the inner row of contacts 13. The invention depicted herein is thus uniquely capable of providing effective contact with more than one row of contact elements 17 located on substrate 19.

As stated, substrate 19 and the respective contact elements 17 preferably comprise a printed circuit board member such that electrical connector 10 is adapted for having the circuit board member inserted therein in either of two directions, vertically (direction "A" in FIG. 1), or laterally (direction "B", FIG. 1). If substrate 19 is a printed circuit board, a plurality of circuit paths 31 may be utilized to provide electrical connection between designated contacts 17 and other components (e.g., resistors, capacitors, etc., not shown) also located on the board 19. In the event that a multi-layered circuit board is used, respective ones of the contact elements 17 may in turn be connected to internal layers (not shown) of circuitry embedded within the insulative substrate material. Circuit boards having such layers are known in the art with connection thereto typically being provided by plated thru holes (not shown) or other conductive media. In the instant invention, each of the contact elements 17 is preferably of the illustrated cylindrical configuration and formed from a metallic wire. In one example, this wire may be beryllium copper and plated with palladium and overplated (a second plating) with a precious metal, preferably gold. Alternatively, a palladium nickel alloy can be used for the plating material. If in the form of a cylindrical wire, each element 17 will preferably possess a diameter within the range from about 0.020 to about 0.040 inch. Securement of each of these wire contact elements 17 to substrate 19 is preferably accomplished by resistance welding or solder reflow. If resistance welding, each wire 17 is welded to a respective, copper circuit path 31 at an appropriate location. If solder reflow, the respective circuit path would be tin-solder plated and each wire 17 held appropriately in place during the heating-reflow (e.g., vapor phase) operation.

Figure 8:
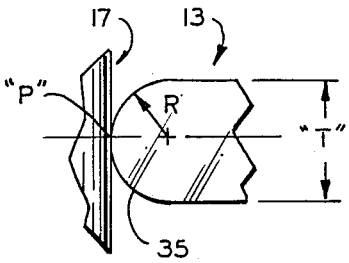
FIG. 8 is an enlarged partial view in plan, showing contact between the torsional contact and contact elements in accordance with a preferred embodiment of the invention, FIG. 8 being taken along the line 8—8 in FIG. 4.

Electrical contact between each of the contacts of the invention and the respective elements 17 occurs at the contacting portions 33 located at the upper end of each contact. Each contacting portion 33 includes a curvilinear segment 35 (see also FIGS. 7 and 8) which provides the mating, wiping contact with the respective wire elements 17, each of which also possess a substantially curvilinear contacting surface. In addition to a curvilinear shape in the elevationed orientation (e.g., FIGS. 4, 5 and 7), the forward contacting edge 35 of each portion 33 of each contact is also curved when viewed in plan (FIG. 8). This dual curvature assures that a substantially singular point type of contact is formed between these two conductive elements (e.g., as illustrated by letter "P" in FIGS. 7 and 8). In a preferred embodiment, the curvature of edge 35 as depicted in plan view in FIG. 8 is approximately one-half the contact's thickness ("T"). This is represented by the letter "R" in FIG. 8, standing for the radius at this part of the contact. In a contact having a thickness "T" of, for example, 0.010 inch, a curvature defined by a radius of 0.005 inch would be preferred.

In addition to the aforementioned end portions 23 and 33 for each contact 13, each contact also includes the defined twisted portion 37 located at the approximate center of the thin contact. In FIGS. 2 and 4, the singular row of contacts depicted on the opposite side of the board from that facing the viewer in FIGS. 1 and 3 are shown. However, these are not shown in FIGS. 1 and 3 for illustration purposes.

As shown in FIGS. 1–5, means 15 for engaging each of the respective torsional contacts to cause these contacts to change from their non-stressed, twisted configuration (FIG. 3) to a straightened, non-twisted configuration (FIG. 1) preferably comprises a slidable member 41 having a plurality of slots 43 therein each designed for accommodating one of the contacts 13. The slidable member 41, when actuated, is designed for moving vertically (upwardly, or downwardly) such that the member rides over each contact (each contact being located within a respective one of these slots as shown). Further, each contact is prevented from displacement during such movement by slidable member 41 by virtue of the contact being securely positioned within base member 11 in the manner described above. Slidable member 41 is preferably of plastic or similar insulative material and, more specifically, preferably of glass filled-polymer. Other suitable plastics for use in member 41 include polyetherimide, polyphenylene and liquid crystal polymer.

Actuation of slidable member 41 is accomplished by a movable actuator member 51, which, as shown in the drawings, is designed for lateral movement within connector 10 (for example, in direction "C" in FIG. 3). this actuation occurs through engagement of stepped cam surfaces 53 and 55 located on members 41 and 51, respectively. Thus, each of the members 41 and 51 includes at least one cam surface so as to enable the cam actuation defined herein to occur, said actuation resulting in movement of these members in a direction substantially perpendicular to one another. More specifically, the actuator member 51 of the invention is designed to move in a lateral (horizontal), reciprocal (back and forth) manner within the invention in relation to the direction of orientation of each of the contacts 13 (and thus the orientation of the respective substrate 19). Member 41, in comparison, moves vertically within the invention and thus upwardly and downwardly, substantially parallel to the upstanding orientation for each contact 13. This direction of movement is depicted by the arrow "D" in FIG. 3 and even better illustrated in comparing the positions of members 41 and 51 in FIGS. 2 and 4. In FIG. 2, for example, the slidable member 41 is shown in its furthermost upward position (being so moved as depicted by the arrow "E"). Member 51 (which could otherwise be defined as a linear cam) is also preferably of the same material as slidable member 41, that is, a plastic. The slidable member 41 of the invention could also be defined as a cam plate member by virtue of its operation relative to the step actuator 51.

Significantly, it is noted that the invention uniquely provides a means whereby a member slidably moves over a plurality of spring-like metallic contacts to cause rotational movement thereof such that each contact can positively engage a respective contact element to provide a positive, wiping form of contact with this element. Deflection of the contacts is thus possible using the teachings of the invention without causing damage to the respective actuator or the respective slidable member which causes such rotational movement. This is considered particularly significant with regard to the invention as it contrasts substantially with the external forms of contact engagement (cam members) typically utilized in the art to cause bending or similar non-twisting deflection of such contacts. The invention is also deemed particularly significant because it will serve to substantially eliminate card motion and/or package deflection associated with such prior systems. The use of card stops/locators also eliminate the need for elaborate retention/constraint devices typically required heretofore. The invention as defined is thus able to provide a more compact design while still assuring operation thereof in a relatively simple fashion.

In FIG. 5, connector 10 is also shown as including a cover 61 having an upper opening 63 therein into which substrate 19 may be inserted (either vertically or horizontally, as depicted in FIG. 1). Cover 61 is preferably plastic or of a similar material to members 41 and 51 and is preferably located on base member 11 such that the invention's contacts, actuator and slidable members are housed therein. Cover 61 and base 11 thus combine to provide a housing for these components and also to accommodate the substrate 19 when positioning thereof is desired. As stated above, during such positioning, the respective contacts are oriented in a non-twisted and thus non-contacting orientation (e.g., FIGS. 1 and 2) and subsequently actuated, by movement of the described cam members, to allow these contacts to assume their normal, twisted configuration (FIGS. 3 and 4) once the substrate 19 is fully inserted within opening 63. Though cover 61 and base 11 are illustrated as separate components in FIG. 5, it is of course within the scope of the invention to form these as a singular component. It is also possible that base 11 could form the base of such a singular component and not include circuitry or the like as part thereof. In such circumstances, contacts 13 could be connected to the aforementioned external means (e.g., wiring).

As clearly shown in FIGS. 2, 4 and 5, the actuator member 51 of the invention includes a plurality of relatively large apertures 71 therein each designed to accommodate a respective one of the lower portions of contacts 13. This is to enable movement of the actuator 51 without engaging the contacts and possibly cause distortion (e.g., bending) thereof. Alternatively, a singular elongated slot or channel could be provided for each row of contacts to thus assure non-engagement therewith by member 51. Openings 71 and respective slots 43 are not shown in FIG. 5 for the outermost row of contacts (shown in phantom). These are shown in FIGS. 2 and 4, however.

Figure 6:
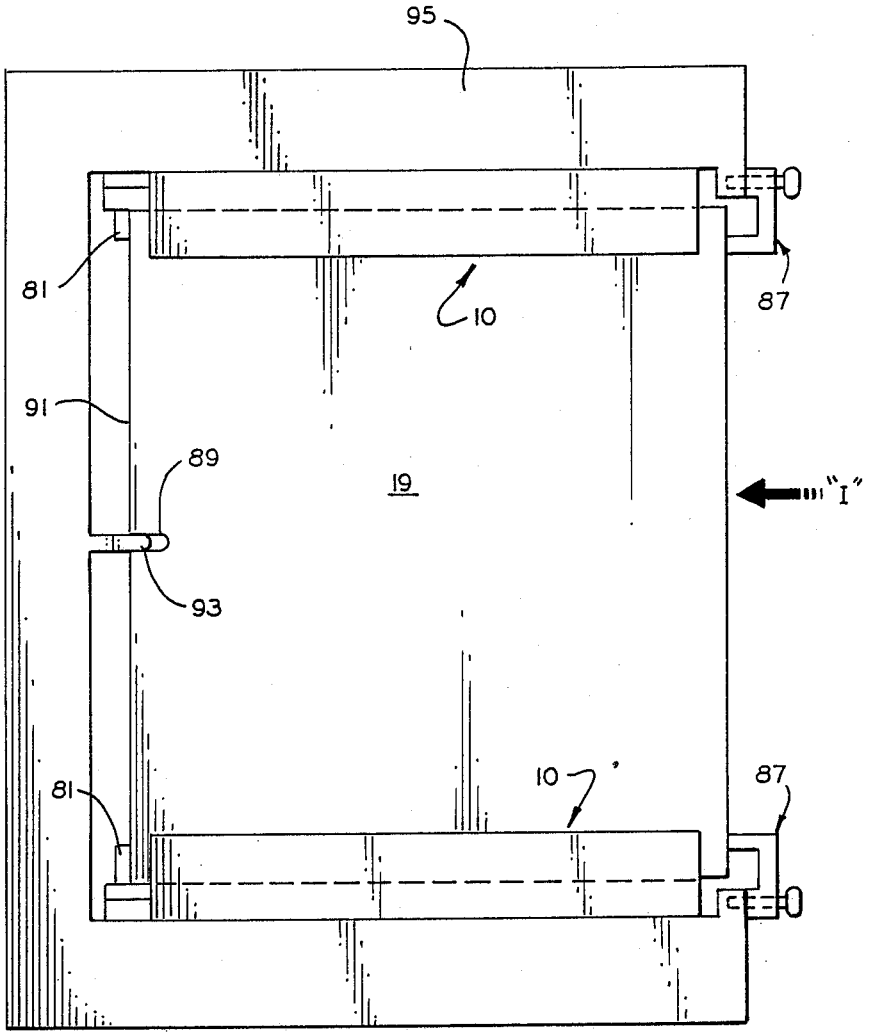
FIG. 6 is an elevational view of an electrical assembly wherein two of the electrical connectors of the invention are shown, these connectors designed for receiving opposing ends of a printed circuit board which is inserted therein.

As illustrated in FIGS. 1 and 3, connector 10 further includes a stop member 81 located on the vertically moving slidable member 41 for proper location of substrate 19 upon insertion within the invention's housing. Stop 81, as shown, comprises an upstanding substantially flat member 82 which engages the forward edge 85 of substrate 19 and thus assures that the substrate is properly registered in order that contact between the respective torsional contacts 13 and elements 17 is assured. Substrate 19 is preferably held within the invention by suitable means, such as by a clamp member 87 (FIG. 6). In the assembly of FIG. 6, a stop means 81 is provided for each of two oppositely positioned electrical connector assemblies 10, each of which is designed for having an opposing end of the substrate 19 slidably inserted therein (direction "I"). Effective connection may thus be provided at both the upper and lower ends of the substrate (e.g., between the contacts in each assembly 10 and respective contacts and associated circuitry formed on the substrate at these ends).

In the assembly of FIG. 6, a location slot 89 is provided within the substrate 19 to assure mating by only one forward edge 91 of the substrate with a corresponding upstanding projection 93 which forms part of the frame assembly 95 designed for accommodating two of the connectors as defined therein. Frame assembly 95 may comprise a card cage assembly as may be utilized in information processing (computer) apparatus. As also shown in FIG. 6, the aforedefined clamping means 87 is used to retain the substrate in final position within the frame. It is also possible to employ other connector assemblies in addition to those illustrated in FIG. 6 such that a plurality of printed circuit boards may be positioned within the frame 95 in a side-by-side relationship. It is also within the scope of the invention to utilize a non-torsional actuated connector for either the upper or lower connectors in the paired relationship represented in FIG. 6. For example, the upper connector may not be torsionally actuated but instead merely designed to provide retention of the upper portion of substrate 19. Other combinations are of course well within the scope of the art and further description is not believed necessary.

Figure 7:
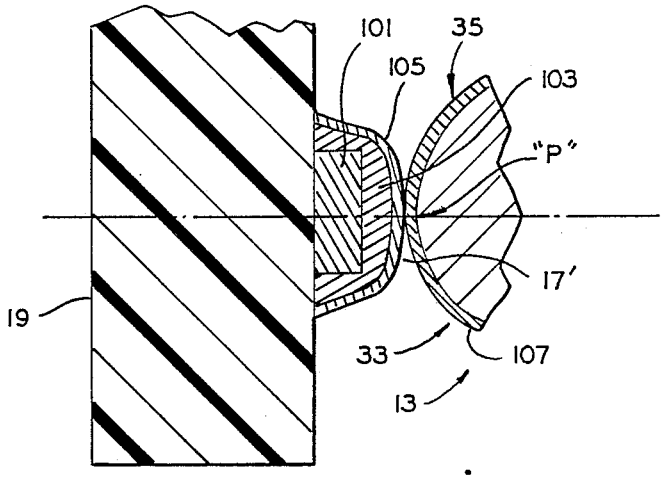
FIG. 7 is an enlarged, sectional view of an alternative embodiment of a contact element capable of being used in the invention, this element shown in position on a substrate and engaging the curvilinear contacting portion of a respective one of the torsional contacts of the invention.

In FIG. 7, there is illustrated a contact element 17 in accordance with an alternative embodiment of the invention. Element 17 may comprise an etched copper layer 101 on the illustrated surface of the insulative substrate 19 and subsequently covered with a quantity of conductive material 103, e.g., nickel. Over this substantially rounded metallic covering may be plated a thin layer 105 of precious metal, such as gold. Such a configuration, somewhat similar to the cylindrical wires defined for elements 17, is thus highly adaptable for providing mating contact with the curvilinear edge segment of the respective contacts 13, said edge segment comprised of the aforementioned berillium copper or phosphor bronze material having the thin layer of plated material (e.g., palladium) 107 located thereon. As also mentioned, a thin layer of gold (not shown) may also be provided on material 107.

There has thus been shown and described an electrical connector wherein at least one torsional contact is provided for providing rotational, positive wiping contact with a respective contact element located on an insulative substrate inserted therein, said substrate insertion capable of being provided in one of two directions. Each contact as defined herein, because of its unique twisted configuration and resulting torsional motion, is capable of providing a contact force at the point of contact within the range of from about 180,000 PSI to about 220,000 PSI, which force, significantly, is substantially greater than that afforded by conventional contact designs of the type described hereinabove. Such a positive force assures effective wiping between these two contacting members to thus assure removal of unwanted debris and other contaminants which can penetrate connectors of the type defined herein and adversely affect the operation thereof. Contact of the type defined herein is thus attainable between the circuitry on the substrate when (when positioned within the housing) and other conductive elements (e.g., circuitry) which may form part of the base component in which the contacts of the invention are securely positioned. The connector as defined herein operates in a relatively simplistic manner and, as defined, can be produced in a relatively inexpensive manner using many known materials.

While there have been shown and described what are at present considered the preferred embodiments of the invention, it will be obvious to those skilled in the art that various changes and modifications may be made therein without departing from the scope of the invention as defined by the appended claims.

What is claimed is:

1. An electrical connector for providing electrical connection to at least one contact element located on a substrate, said connector comprising:

a base member;

at least one torsional contact for contacting said contact element located on said substrate to provide said electrical connection, said torsional contact adapted for occupying a first, twisted orientation relative to said substrate and a second, substantially non-twisted orientation relative to said substrate; and means for engaging said torsional contact to cause said contact to move from said first, twisted orientation to said second, substantially non-twisted orientation.

2. The connector according to claim 1 wherein said torsional contact provides said electrical connection with said contact element while in said first, twisted orientation.

3. The connector according to claim 1 wherein said torsional contact comprises a contacting portion for contacting said contact element on said substrate and at least one twisted portion when said torsional contact occupies said first, twisted orientation.

4. The connector according to claim 3 wherein said contacting portion of said torsional contact includes a substantially curvilinear edge segment, said edge segment contacting said contact element when said torsional contact occupies said first, twisted orientation.

5. The connector according to claim 1 wherein said means for engaging said torsional contact to cause said torsional contact to move from said first position to said second position comprises a slidable member for slidably engaging said torsional contact.

6. The connector according to claim 5 wherein said means for engaging said torsional contact further comprises an actuator member for engaging said slidable member to cause said slidable member to slidably engage said torsional contact.

7. The connector according to claim 6 wherein said slidable member and said actuator member each include at least one cam surface thereon, said cam surfaces engaging when said actuator member engages said slidable member to thereby form a camming type of engagement therebetween.

8. The connector according to claim 7 wherein said slidable and actuator members are both of electrically insulative material.

9. The connector according to claim 7 wherein each of said cam surfaces are of substantially stepped configuration.

10. The connector according to claim 1 further including a cover for providing cover for said torsional contact and said means for engaging said contact, said cover and said base member providing a housing for said contact and said engaging means.

11. The connector according to claim 10 wherein said cover includes an opening therein, said substrate having said contact element located thereon being positioned substantially within said housing through said opening within said cover.

12. The connector according to claim 11 wherein said substrate having said contact element thereon comprises a printed circuit board, said connector being a zero insertion force connector.

13. The connector according to claim 1 wherein said base member comprises a printed circuit board having electrical circuitry thereon, said torsional contact being electrically coupled to said conductive circuitry thereon.

14. The connector according to claim 1 wherein said contact element located on said substrate includes a curvilinear contacting surface and said contacting portion of said torsional contact includes an edge segment of substantially dual curvilinear configuration, said edge segment engaging said curvilinear contacting surface of said element in a wiping fashion when said contact moves to said first, twisted orientation.

15. The connector according to claim 1 wherein said torsional contact is comprised of metallic material.

16. The connector according to claim 15 wherein said metallic material is selected from the group consisting of beryllium copper and phosphor bronze.

17. The connector according to claim 16 wherein said torsional contact includes plating material thereon.

18. The connector according to claim 17 wherein said plating material is palladium.

* * * * *